US009238895B2

(12) United States Patent
Niekamp et al.

(10) Patent No.: US 9,238,895 B2
(45) Date of Patent: Jan. 19, 2016

(54) ANTI-DRY FIRE MECHANISM FOR A POST DRIVER

(71) Applicant: Danuser LLC, Fulton, MO (US)

(72) Inventors: Gary J Niekamp, Jefferson City, MO (US); Tyler Van Lant, Columbia, MO (US)

(73) Assignee: DANUSER LLC, Fulton, MO (US)

( * ) Notice: Subject to any disclaimer, the term of this patent is extended or adjusted under 35 U.S.C. 154(b) by 513 days.

(21) Appl. No.: 13/753,214

(22) Filed: Jan. 29, 2013

(65) Prior Publication Data

US 2013/0140052 A1 Jun. 6, 2013

(51) Int. Cl.
*E02D 7/08* (2006.01)
*E02D 7/06* (2006.01)

(52) U.S. Cl.
CPC ..... *E02D 7/08* (2013.01)

(58) Field of Classification Search
CPC ..... E02D 7/06; E02D 7/08
USPC ..... 173/89, 128, 81–84, 93, 126, 133
See application file for complete search history.

(56) References Cited

U.S. PATENT DOCUMENTS 3,205,952 A * 9/1965 Sicotte ..... 173/124
4,405,020 A * 9/1983 Rassieur ..... 173/89
6,105,683 A 8/2000 Thiessen
6,702,037 B1 3/2004 Thiessen

OTHER PUBLICATIONS

Danuser Hammer advertisement from Compact Equipment magazine, published Apr. 2012, p. 25.
Images of Anti-Dry Fire Mechanism, Jul. 24, 2012.
Danuser Postmaster brochure, at least as early as Aug. 8, 2007.
Danuser Hammer SM40, Operator's Manual, Jul. 10, 2012.
Danuser Hammer brochure, at least as early as Feb. 7, 2012.
Quick Attach Attachments, Inc. Quick Sledge brochure, at least as early as 2011.
Bradco PD4800 Post Driver, Operator's and Parts Manual, published Aug. 16, 2005, pp. 4-6.
Bradco PD4800 Post Driver, Operator's and Parts Manual, published Aug. 20, 2005, p. 3.
Bradco PD4800 Post Driver, Operator's and Parts Manual, published Sep. 28, 2005, p. 25.
Bradco PD4800 Post Driver, Operator's and Parts Manual, published Mar. 20, 2008, p. 23.
Bradco PD4800 Post Driver, Operator's and Parts Manual, published Jul. 9, 2008, pp. 26-29.
Bradco PD4800 Post Driver, Operator's and Parts Manual, published Jul. 10, 2008, pp. 7, 8, 10-13, and 16.
Bradco PD4800 Post Driver, Operator's and Parts Manual, published Jul. 14, 2008, p. 14.

(Continued)

*Primary Examiner* — Michelle Lopez
(74) *Attorney, Agent, or Firm* — Husch Blackwell LLP

(57) ABSTRACT

The post driver machine includes a housing, inside of which is a weight which can be lifted by a chain being rotated around a generally elliptical path by a powered sprocket. A catch mechanism is affixed to the chain, and can engage with a weight catch attached to the weight. However, when there is not a post positioned within the post driver, the weight rests at a position too low the weight catch to engage with the catch mechanism. Upon properly inserting a post into the post driver, the post presses upwardly on the weight until the weight catch engages with the catch mechanism to lift the weight.

7 Claims, 3 Drawing Sheets

(56) References Cited

OTHER PUBLICATIONS

Bradco PD4800 Post Driver, Operator's and Parts Manual, published Jul. 21, 2008, pp. 17-20.
Bradco PD4800 Post Driver, Operator's and Parts Manual, published Jul. 22, 2008, p. 40.
Bradco PD4800 Post Driver, Operator's and Parts Manual, published Jul. 23, 2008, pp. 9, 30-39, and 41.
Bradco PD4800 Post Driver, Operator's and Parts Manual, published Jul. 24, 2008, pp. 1, 15, 21, 22, 24, 42-43.
Bradco PD4800 Post Driver, Operator's and Parts Manual, published Aug. 8, 2008, cover page.

* cited by examiner

ANTI-DRY FIRE MECHANISM FOR A POST DRIVER

CROSS-REFERENCE TO RELATED APPLICATIONS

No related application.

BACKGROUND OF THE INVENTION

The present invention relates generally to a post driver machine and, more particularly, to a weight catch mechanism which is especially adapted to prevent the post driver machine from "dry-firing" when there is no post engaged with the post driver machine.

A post driver machine is used for driving large posts into the ground. In general, post drivers utilize a pile driving principle in which a weight is raised to some distance above a post, and is then dropped in order to drive the post into the ground. Such post drivers rely on a post being present to dissipate the energy of the falling weight. When a post is properly positioned within the post driver, the kinetic energy of the falling weight is transferred into the post, pushing it into the ground. However, when a post is not properly positioned within the post driver, the weight may fail to contact the post upon falling, and may instead impact upon the frame of the post driver. Such a so-called "dry-fire" can damage the post driver apparatus. Repeated dry-firing often results in damage to the framework and mechanical structure of the post driver machine. Additionally, each dry-fire is time lost, as the post driver machine must be repositioned and the weight lifted back up and dropped again.

Thus, the presence or absence of a post within a post driver machine has important consequences for the post driver machine's performance and structural integrity. In many existing post driver machines, once the process of lifting and dropping the weight (called a "cycle" or a "stroke") has been initiated, the stroke will occur regardless of whether a post is positioned within the machine. Generally, it is left to the operator of the apparatus to decide when a stroke should occur. However, operator error is often of great concern.

A post driver machine is typically attached to a front loader, skid-steer, backhoe or similar vehicle so that the machine can be moved from location to location, allowing posts to be easily placed into the ground at desired locations. The operator's view of the post in the post driver is often at least partially obscured by the body of the post driver itself. Therefore, the operator may not be in the best position to decide when the post is properly positioned to initiate a stroke.

Thus, in current designs for post driver machines, there is therefore a need for preventing dry-firing, and largely removing the possibility for operator error.

SUMMARY OF THE INVENTION

The present invention teaches the construction and operation of a post driver machine which includes a mechanism which is designed to prevent the post driver machine from dry firing when there is no post engaged within the machine.

The post driver machine includes a housing. Inside the housing is a weight which can be lifted by a chain being rotated around a generally elliptical path by a powered sprocket. A catch mechanism is affixed to the chain, and can engage with a weight catch attached to the weight. However, when there is not a post positioned within the post driver, the weight rests at a position too low the weight catch to engage with the catch mechanism. Upon properly inserting a post into the post driver, the post presses upwardly on the weight until the weight catch engages with the catch mechanism to lift the weight.

In one embodiment, a post driver machine comprises a powering mechanism engaged with and operable to move a lifting mechanism along a path; a catch mechanism attached to the lifting mechanism for movement therewith; a weight movably positioned within a housing; and a weight catch attached to the weight, wherein the weight is movable between a resting position in which the weight catch is positioned such that it does not engage with the catch mechanism, and an engagement position in which the weight catch engages with the catch mechanism as the catch mechanism moves with the lifting mechanism to lift the weight.

In another embodiment, a post driver machine comprises a housing; a sprocket engaged with and operable to move a chain around a generally elliptical path within the housing; a catch mechanism attached to the chain for movement therewith; a weight movably positioned within the housing; and a weight catch attached to the weight, wherein positioning the housing over and onto a post causes the post to push upwardly on the weight such that the catch mechanism can engage with the weight catch to lift the weight.

Specific advantages and features of the present assembly will be apparent from the accompanying drawings and the description of several illustrative embodiments of the present invention.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 2:
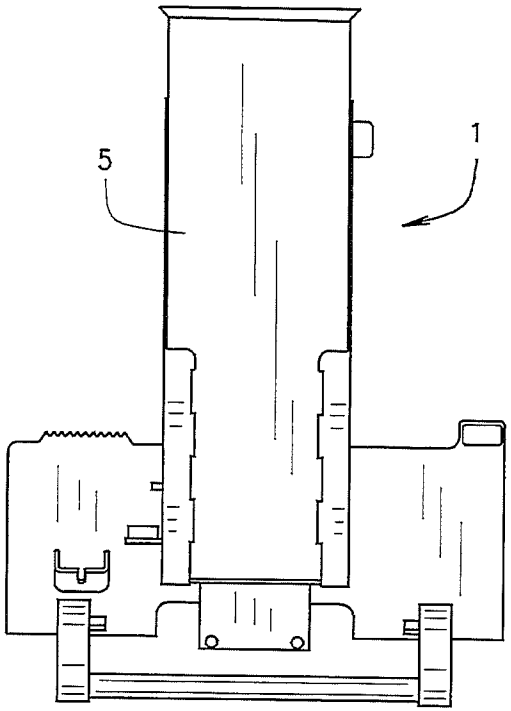
FIG. 2 is a front elevation view of the post driver machine of FIG. 1.
Figure 1:
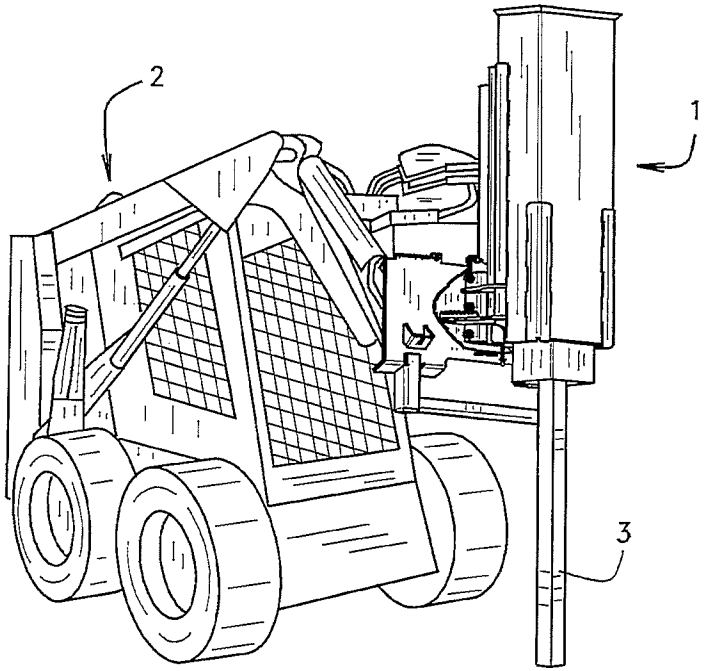
FIG. 1 is a perspective view of a post driver machine mounted in front of a mobile vehicle, such as a skid-steer.

Referring to FIG. 1, an embodiment of the present post driver 1 is shown as connected to a skid-steer loader 2, in position to drive a post 3 into the ground. Post driver 1 may instead be adapted for attachment to and operation via a front-end loader or any other suitable vehicle. As shown in FIG. 2, post driver 1 includes an outer housing 5 which contains the internal workings of the post driver 1, and associated frame structure for connecting the post driver 1 to the skid-steer loader 2.

Figure 3:
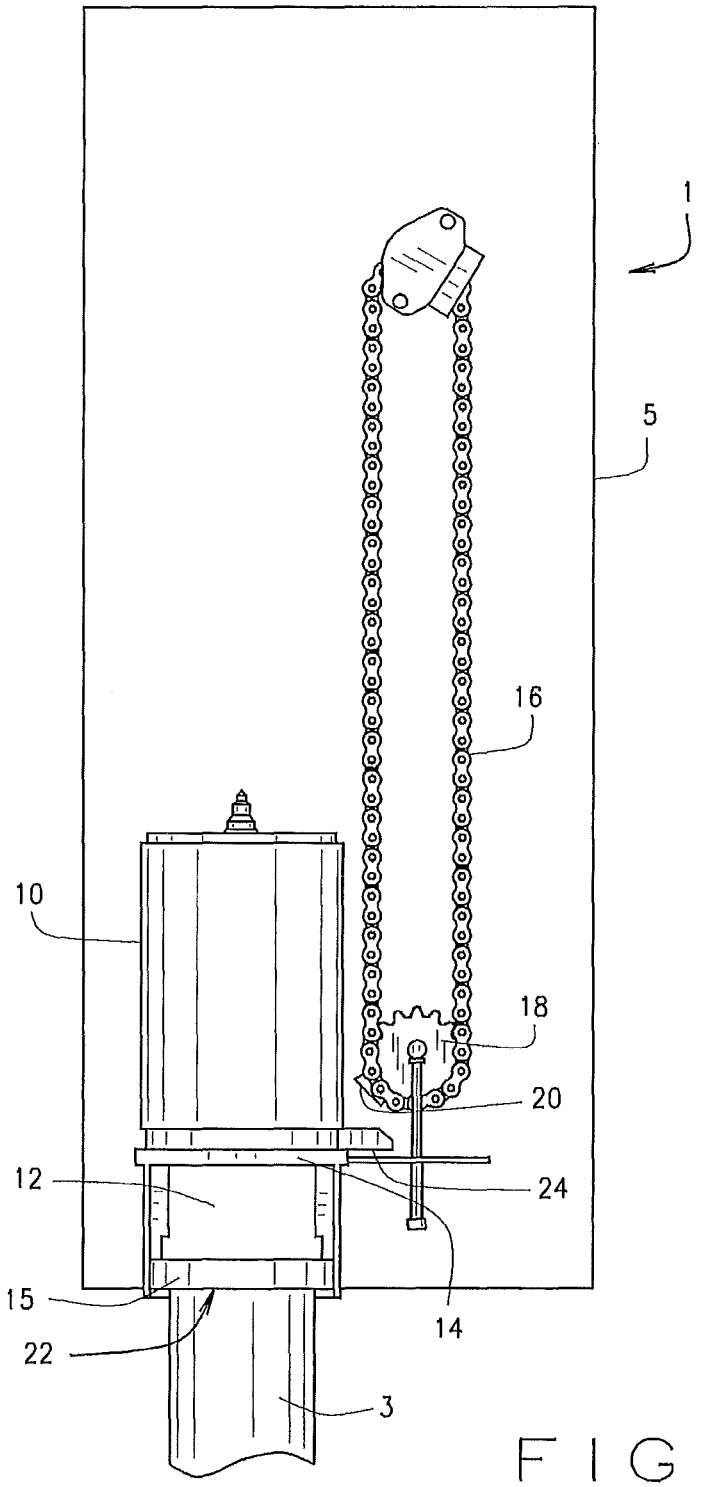
FIG. 3 is a cross-sectional view of the post driver machine of FIG. 1, taken through the housing prior to engaging a post.

As can be seen in FIG. 3, the internal workings of post driver 1 may include a weight (or hammer) 10 with a protrusion member 12 extending from the bottom thereof. The weight 10 and protrusion member 12 are preferably comprised of a heavy, durable material as would be known to one of ordinary skill in the art. Below the weight 10 is positioned a fixed upper barrier 14 which includes a through hole. The hole is sized and shaped to allow the protrusion member 12 of the weight 10 to pass therethrough when the weight 10 is allowed to fall for each stroke of the post driver 1. Preferably, the protrusion member 12 is long enough to impact substantially all of the kinetic energy from the falling weight 10 into a post 3 before the weight 10 impacts the fixed upper barrier 14.

Residing below the fixed upper barrier 14 is a floating anvil 15. Floating anvil 15 is designed to be positioned between the weight 10 and the post 3 during operation of the post driver 1. When the weight 10 falls, the protrusion member 12 falls through the hole in fixed upper barrier 14, and strikes the floating anvil 15. In normal operation, floating anvil 15 would be positioned so as to rest on top of a post 3, such that the kinetic energy from the weight 10 and protrusion member 12 pass through the floating anvil 15 and into the post 3. This protects the post 3 from damage from the falling weight 10, but still drives the post 3 into the ground. For this reason, floating anvil 15 is preferably comprised of a durable material as would be known to one of ordinary skill in the art.

Figure 4:
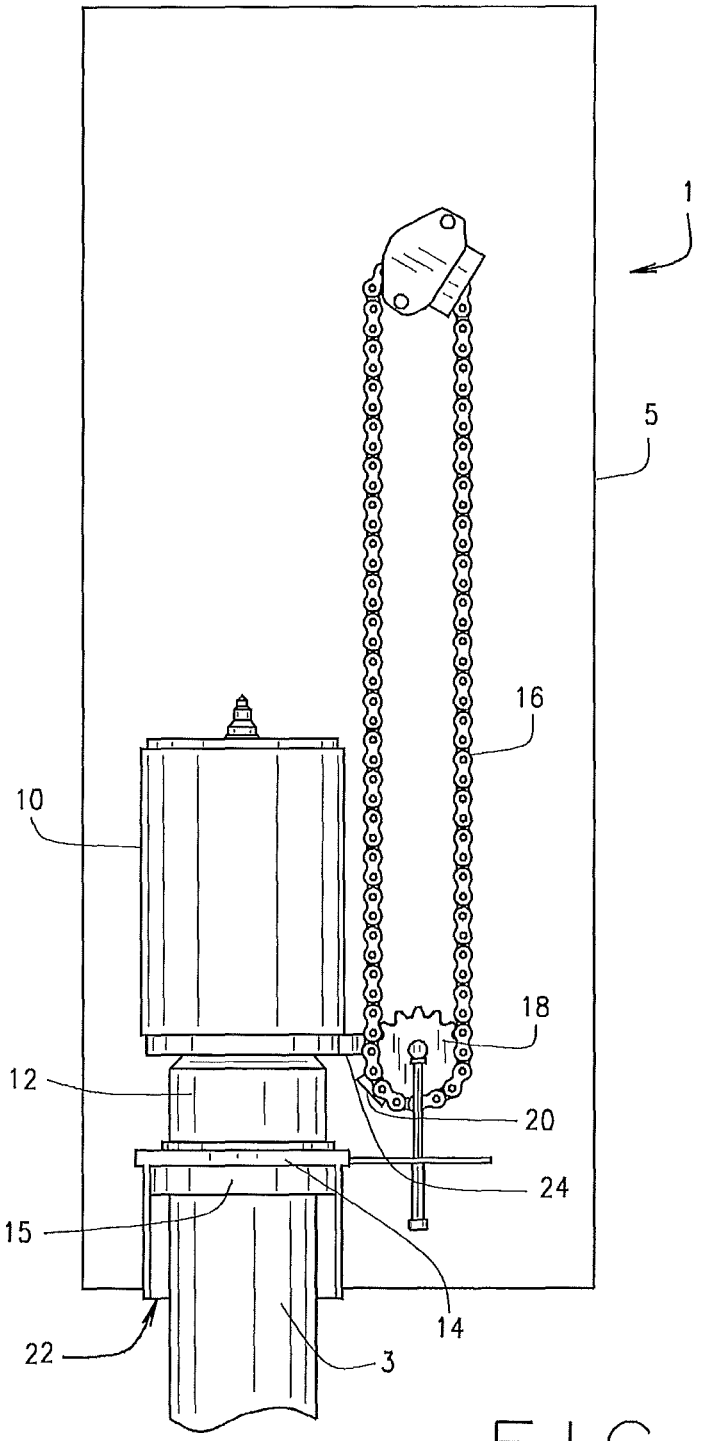
FIG. 4 is a cross-sectional view of the post driver machine of FIG. 1, taken through the housing upon engagement with a post.

Housing 5 may further include a lifting structure which is moved by a powering structure, which are respectively shown in FIGS. 3 and 4 as chain 16 and sprocket 18. As shown, chain 16 is operably connected to sprocket 18, with the chain 16 and the sprocket 18 cooperating together to rotate a catch mechanism 20 along the path of the chain. However, as will be understood, the lifting structure need not be a chain and the powering structure need not be a sprocket. Similarly, the lifting structure may simply be powered to move up and down along a substantially straight-line path by the powering structure, rather than move around a generally elliptical path as shown. Further, the sprocket 18 may be powered by a motor (not shown).

The weight 10 may further include a flange (or weight catch) 24 which extends from one side of the weight 10. The weight catch 24 is structured to engage with catch mechanism 20 as catch mechanism 20 is lifted by chain 16. When the weight 10 is properly positioned, catch mechanism 20 engages with weight catch 24, and as the catch mechanism 20 is lifted by chain 16, the weight 10 is also lifted. Once the catch mechanism 20 reaches substantially the top of chain path, the catch mechanism disengages from the weight catch 24, and the weight 10 is allowed to fall. Such disengagement may occur simply from the catch mechanism 20 moving away from the weight catch 24 as it rotates along the chain path.

As can be seen in FIG. 3, when there is no post 3 positioned within the housing 5, the floating anvil 15 merely rests at the bottom of the housing 15. Weight 10 similarly rests on or near the fixed upper barrier 14, with the protrusion member 12 extending through the hole in the fixed upper barrier 14 and resting on or near the floating anvil 15. In this resting position, the weight catch 24 is positioned below the lowest level at which it could be engaged by the catch mechanism 20. Thus, when there is no post which is properly positioned within the post driver 1, the weight cannot be lifted by the chain 16 and catch mechanism 20.

On the other hand, as can be seen in FIG. 4, when a post 3 is properly positioned within the post driver 1, the post 3 pushes upwardly on the floating anvil 15. This upward movement of the floating anvil 15 pushes upwardly on the protrusion member 12 of weight 10, moving the weight 10 upward as well. When the post 3 is properly positioned within the post driver 1, the post 3 pushes the floating anvil 15 and weight 10 to an engagement position in which the weight catch 24 has been raised to a level at which the catch mechanism 20 on the chain 16 can engage with the weight catch 24. Thus, only upon proper insertion of a pole 3 into the post driver 1 will the weight 10 be able to cycle. This structure prevents dry-firing of the post driver 1.

As shown in FIGS. 3 and 4, only a single catch mechanism 18 is positioned on chain 16. In an alternative embodiment, multiple catch mechanisms 18 may be located on the chain 16. Catch mechanism 18 may be a hook or other structure capable of engaging with and lifting the weight 10. In another alternative embodiment, weight catch 24 may engage and be lifted directly by the chain 16 when the wright catch 24 reaches a sufficient height. Additionally, the post driver 1 need not include the floating anvil 15, and the post 3 may instead push the weight 10 upward directly. Similarly, the weight need not include a protrusion member 12.

Thus, there has been shown and described an embodiment of a novel post driver machine. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A post driver machine comprising:

a powering mechanism engaged with and operable to move a lifting mechanism along a path;

a catch mechanism attached to the lifting mechanism for movement therewith;

a weight including a protrusion member movably positioned within a housing;

a weight catch attached to the weight;

a fixed upper barrier through which at least a portion of the protrusion member of the weight extends; and a floating anvil positioned below the fixed upper barrier, wherein the fixed upper barrier prevents the floating anvil from rising above the level of the fixed upper barrier;

wherein the weight is movable between a resting position in which the weight catch is positioned such that it does not engage with the catch mechanism, and an engagement position in which the weight catch engages with the catch mechanism as the catch mechanism moves with the lifting mechanism to lift the weight.

2. The post driver machine of claim 1 wherein the powering mechanism is a sprocket.

3. The post driver machine of claim 1 wherein the lifting mechanism is a chain.

4. The post driver machine of claim 3 wherein the path is a generally elliptical path.

5. The post driver machine of claim 1 wherein the proper positioning of a post within the housing causes the weight to move into the engagement position.

6. The post driver machine of claim 1 wherein the catch mechanism is structured to release the weight catch at a point along the path.

7. A post driver machine comprising:

a housing;

a sprocket engaged with and operable to move a chain around a generally elliptical path within the housing;

a catch mechanism attached to the chain for movement therewith;

a weight including a protrusion member movably positioned within the housing;

a weight catch attached to the weight;

a fixed upper barrier through which at least a portion of the protrusion member of the weight extends; and a floating anvil positioned below the fixed upper barrier, wherein the fixed upper barrier prevents the floating anvil from rising above the level of the fixed upper barrier;

wherein positioning the housing over and onto a post causes the post to push upwardly on the weight such that the catch mechanism can engage with the weight catch to lift the weight.

* * * * *